US009911302B2

(12) United States Patent
Helal

(10) Patent No.: US 9,911,302 B2
(45) Date of Patent: Mar. 6, 2018

(54) SAFETY STAIRS

(71) Applicant: Julia E. Helal, Mystic, CT (US)

(72) Inventor: Julia E. Helal, Mystic, CT (US)

( * ) Notice: Subject to any disclaimer, the term of this patent is extended or adjusted under 35 U.S.C. 154(b) by 0 days.

(21) Appl. No.: 15/336,349

(22) Filed: Oct. 27, 2016

(65) Prior Publication Data

US 2017/0337796 A1 Nov. 23, 2017

Related U.S. Application Data

(60) Provisional application No. 62/337,389, filed on May 17, 2016.

(51) Int. Cl.

| | |
|---|---|
| ***G08B 23/00*** | (2006.01) |
| ***G08B 21/04*** | (2006.01) |
| ***G08B 25/12*** | (2006.01) |
| ***G08B 3/10*** | (2006.01) |
| ***G08B 5/36*** | (2006.01) |

(52) U.S. Cl.

CPC ..... *G08B 21/0438* (2013.01); *G08B 3/10* (2013.01); *G08B 5/36* (2013.01); *G08B 25/12* (2013.01)

(58) Field of Classification Search

CPC .... G08B 21/02; G08B 21/04; G08B 21/0423; G08B 21/0438–21/0492; G08B 25/016; G08B 3/10; G08B 5/36; G08B 25/12

USPC ..... 340/573.1; 600/300, 595

See application file for complete search history.

(56) References Cited

U.S. PATENT DOCUMENTS

| | | | | |
|---|---|---|---|---|
| 2009/0139798 | A1* | 6/2009 | Bernard | E06C 7/003 182/18 |
| 2009/0171166 | A1* | 7/2009 | Amundson | A61B 5/0002 600/301 |
| 2010/0108443 | A1* | 5/2010 | Uche | E04F 11/1863 182/137 |
| 2011/0102173 | A1* | 5/2011 | Husain | G08B 21/0238 340/539.13 |
| 2014/0251396 | A1* | 9/2014 | Subhashrao | A61H 3/061 135/66 |
| 2016/0237690 | A1* | 8/2016 | Hyde | E04F 11/1863 |

* cited by examiner

*Primary Examiner* — Thomas Mullen

(74) *Attorney, Agent, or Firm* — McCormick, Paulding & Huber LLP

(57) ABSTRACT

A stairway safety system and method including movement sensors and/or force sensors, a safety button, a central processing unit, a user notify device configured to generate audio or visual indications prompting the stairway user to engage the safety button, and a communication device configured to send a message requesting help. The central processing unit is configured to measure the length of time between detecting signals from the sensors and also to instruct the first user notify device to generate audio or visual indications when the measured time between detecting the signals is shorter or longer than a stairway user's actual or estimated typical travel time through the stairway. The central processing unit is configured to measure time and to instruct the communication device to send the message requesting help if a safety signal is not detected within a safety time period which indicates a request for help may be needed.

20 Claims, 5 Drawing Sheets

SAFETY STAIRS

CROSS-REFERENCE TO PRIOR APPLICATION

This application claims priority to U.S. Provisional Patent Application No. 62/337,389, filed May 17, 2016, which is hereby incorporated herein by reference in its entirety.

TECHNICAL FIELD

The present disclosure relates generally to stairway safety systems and methods.

BACKGROUND

In the course of stairway travel, a user may accidentally trip and, thus, fall while in the stairway. Minor to serious injuries to the user can result due to a fall in a stairway. For instance, an injury from a stairway fall can render the user unconscious, immobile or otherwise incapable of requesting help.

SUMMARY

According to the present disclosure, a stairway safety system comprising a first movement sensor configured to generate a first movement signal when movement of a stairway user is detected in a first area of a stairway, a second movement sensor configured to generate a second movement signal when movement of the stairway user is detected in a second area of the stairway remote from the first area of the stairway, a safety button configured to generate a safety signal when engaged by a stairway user, a central processing unit configured to detect the first movement signal, second movement signal and safety signal, a first user notify device configured to generate audio or visual indications prompting the stairway user to engage the safety button, and a communication device configured to send a message requesting help, wherein the central processing unit is configured to measure the length of time between detecting the first movement signal and the second movement signal, wherein the central processing unit is configured to generate a first notify signal that instructs the first user notify device to generate the audio or visual indications when the central processing unit determines that the measured time between detecting the movement signals is within a first predetermined time period, which is shorter than a stairway user's actual or estimated typical travel time through the stairway, wherein the central processing unit is configured to measure the length of time beginning at or after the first notify signal is generated until the safety signal is detected, and wherein the central processing unit is configured to generate a help signal that instructs the communication device to send the message requesting help if the central processing unit determines that the safety signal is not detected after the first notify signal is generated within a safety time period which indicates a request for help may be needed.

According to the present disclosure, a stairway safety system comprising a first force sensor configured to be positioned under, within or on top of a first tread of a staircase and to generate a first force signal when a force is applied to the first force sensor by a stairway user, a second force sensor configured to be positioned under within or on top of a second tread of the staircase and to generate a second force signal when a force is applied to the second force sensor by the stairway user, a safety button configured to generate a safety signal when engaged by a stairway user, a central processing unit configured to detect the first force signal, second force signal and safety signal, a first user notify device configured to generate audio or visual indications prompting the stairway user to engage the safety button, and a communication device configured to send a message requesting help, wherein the central processing unit is configured to measure the length of time between detecting the first force signal and the second force signal, in either order, wherein the central processing unit is configured to generate a first notify signal that instructs the first user notify device to generate the audio or visual indications when the central processing unit determines that the measured time between detecting the first force signal and the second force signal, in either order, is within a first predetermined time period, which is shorter than the stairway user's actual or estimated typical travel time through the stairway, wherein the central processing unit is configured to measure the length of time beginning at or after the first notify signal is generated until the safety signal is detected, and wherein the central processing unit is configured to generate a help signal that instructs the communication device to send the message requesting help if the central processing unit determines that the safety signal is not detected after the first notify signal is generated within a safety time period which indicates a request for help may be needed.

According to the present disclosure, a stairway safety method includes the steps of monitoring, by a central processing unit, the movement of a stairway user between spaced stations along a stairway, determining, by the central processing unit, if the movement between spaced stations is too short or too long, and generating, by a user notify device, audio or visual indications prompting the stairway user to engage a safety button.

These and other aspects, features and advantages of the present disclosure will become apparent in light of the following detailed description of non-limiting embodiments, with reference to the accompanying drawings.

DETAILED DESCRIPTION

Before the various embodiments are described in further detail, it is to be understood that the present disclosure is not limited to the particular embodiments described. It will be understood by one of ordinary skill in the art that the systems and methods described herein may be adapted and modified as is appropriate for the application being addressed and that the systems and methods described herein may be employed in other suitable applications, and that such other additions and modifications will not depart from the scope thereof.

Although various features have been shown in different figures for simplicity, it should be readily apparent to one of skill in the art that the various features may be combined without departing from the scope of the present disclosure.

Figure 1:
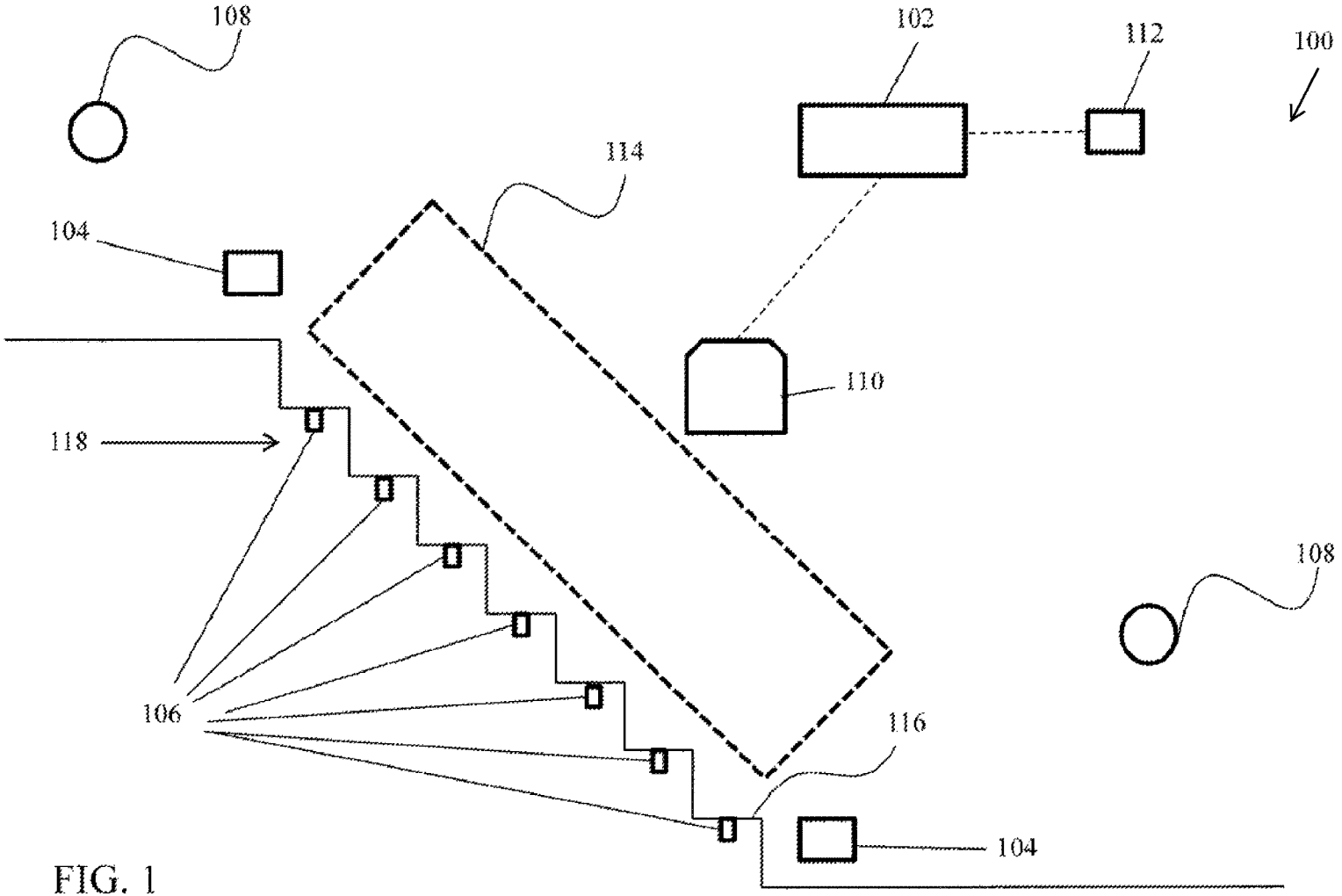
FIG. 1 is a schematic view of an exemplary stairway safety system installed in a stairway.

FIG. 1 shows an exemplary stairway safety system 100 including a central processing unit 102, two movement sensors 104, a plurality of force sensors 106, two safety buttons 108, a user notify device 110 and a communication device 112. One of the movement sensors 104 is positioned substantially near the top of the stairway 114 while the other movement sensor 104 is positioned substantially near the bottom of the stairway 114. One of the safety buttons 108 is placed on a wall beyond the stairway 114 substantially near the top of the stairway 114 while the other safety button 108 is placed on a wall beyond the stairway 114 substantially near the bottom of the stairway 114. As shown, each force sensor 106 of the plurality of force sensors 106 is positioned under, within or on top of the tread 116 of each step of the staircase 118. However, force sensors 106 may also be positioned in other areas of a staircase 118, for example, an intermediate landing (not shown) of a staircase 118. The user notify device 110 is positioned substantially near the stairway 114. There is flexibility in the positioning of the user notify device 110. For instance, the user notify device 110 could be positioned centrally with respect to the stairway 114 or towards one end of the stairway 114. Alternatively, there could be more than one user notify device 110 positioned in different locations in relation to the stairway 114.

The central processing unit 102 is configured to receive and detect movement signals from the movement sensors 104, force signals from the force sensors 106 and safety signals from the safety buttons 108. The central processing unit 102 can receive and detect signals from the movement sensors 104, force sensors 106 and safety buttons 108 through wired connections or, alternatively, through wireless connections. For sake of visual clarity, FIG. 1 does not show markings for wired or wireless connections of the movement sensors 104, force sensors 106 and safety buttons 108 to the central processing unit 102. The central processing unit 102 is also configured to measure the length of time that passes between signals received or detected from the movement sensors 104, force sensors 106 and safety buttons 108. The central processing unit 102 may be positioned near the stairway 114 or, alternatively, the central processing unit 102 may be positioned elsewhere not near the stairway 114.

The central processing unit 102 is also configured to generate signals that instruct the user notify device 110 and the communication device 112. The central processing unit 102 may generate signals that instruct the user notify device 110 and communication device 112 through wired connections or, alternatively, through wireless connections. The communication device 112 may be positioned near the stairway 114 or, alternatively, the communication device 112 may be positioned elsewhere not near the stairway 114.

The central processing unit 102 is also configured to store information such as address or location of the stairway 114 that the stairway safety system 100 is installed and/or information relating to users that may travel through the stairway 114 on a regular basis. This information may be input through a dedicated terminal of the central processing unit 102 or, alternatively, through a computer or mobile device that can connect and interface with the central processing unit 102 through a wired or wireless connection.

The movement sensors 104 may utilize any type of motion sensing technology. For example, the movement sensors may be passive infrared, microwave, area reflective and/or ultrasonic type movement sensors 104. The movement sensors 104 are configured to generate movement signals, which are capable of being detected by the central processing unit 102, when there is movement sensed in a defined area near the movement sensor 104. The defined area can be adjusted based on the size and/or shape of the area near the movement sensor 104.

Figure 2:
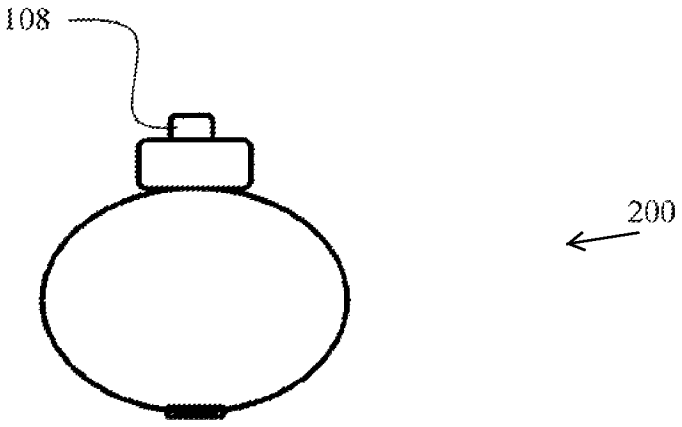
FIG. 2 is a front view of an exemplary user worn device including a safety button.
Figure 3:
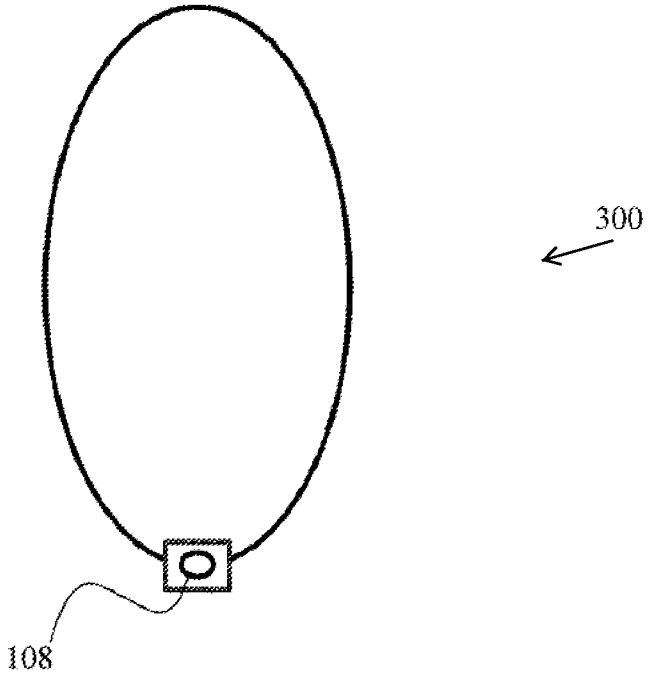
FIG. 3 is a front view of another exemplary user worn device including a safety button.

The safety buttons 108 are configured to be engaged by a user. The safety buttons 108 are configured to generate safety signals, which are capable of being detected by the central processing unit 102, whenever the safety button 108 is engaged. The safety buttons 108 may be of any design and shape. For example, the safety button 108 may be a physical knob that depresses when engaged by a user or a touchscreen interface. With reference to FIGS. 2 and 3, a safety button 108 can be positioned on a user worn device such as, for example, a bracelet 200, as seen in FIG. 2, or a necklace 300, as seen in FIG. 3. The safety button 108 being positioned on a user worn device 200, 300 may be in alternative to safety buttons 108 being positioned on a wall near a stairway 114 or, instead, may be in addition to safety buttons 108 positioned on a wall. The safety button 108 may also be configured to generate a visual effect on or near a surface where a user may engage the safety button 108. For example, the safety button 108 may generate the visual effect of displaying "I am OK" on a surface that the user may touch or press to engage the safety button 108.

The force sensors 106 may utilize any type of force sensing technology including, without limitation, piezoelectric sensing technology, accelerometers, strain gauges, or the like. As shown, there is a force sensor 106 positioned for each tread 116 of the staircase 118. However, it should be understood that there may be more or fewer force sensors for each tread 116. For example, there could be a force sensor 106 positioned on every other tread 116 of the staircase 118 or more than one force sensor 106 for each tread 116 of the staircase 118. Each force sensor 106 is configured to generate a force signal, which is capable of being detected by the central processing unit 102, when an applied force is sensed. The force sensors 106 may be configured to only sense an applied force in a binary value manner, for example, there is either force detected or no force detected. Alternatively, the force sensors 106 may be configured to measure varying degrees of applied force and also generate a corresponding varying force signal, which is capable of being detected by the central processing unit 102, based on the sensed magnitude of the applied force.

The user notify device 110 is configured to generate indications through audio and/or visual means. For example, the user notify device 110 may be equipped with one or more speakers that can generate an audio indication such as, for example, a bell sound, whistle sound, or horn sound. Alternatively, the audio generated could be a verbal question or command such as, for example, "are you OK?" or "please press a safety button." For visual indications, the user notify device 110 may be equipped with one or more lights or monitors that generate a visual effect such as, for example, a strobing light or a constant red colored light. Alternatively, the stairway safety system 100 may be designed such that a first user notify device 110 is configured to generate only audio indications and a second user notify device 110 is configured to generate only visual indications. Thus, the central processing unit 102 may be configured to generate notify signals to either or both of the first user notify device 110 and the second user notify device 110 when either or both of an audio and/or a visual indication is desired.

The communication device 112 may be configured to send a message to at least one recipient. The message may indicate that a stairway user fall event, which is discussed in more detail below, has occurred. The message may also include information such as address or location of the stairway 114 and/or information relating to users of the stairway 114. The message may be distributed by text message, voice call, email, radio signal or via any other communication means known by a person skilled in the art. Identifying information of intended recipients of the message, such as phone number, email address, or radio frequency, can be entered into and stored in the central processing unit 102. The central processing unit 102 can be configured so that a list of recipients, i.e. an emergency contact list, can be entered into a memory unit of the central processing unit 102. The emergency contact list stored in the central processing unit 102 may include, without limitation, one or more of the following: 911 emergency response services, family member, friend, caretaker, neighbor, etc.

In operation, the central processing unit 102 is configured to determine if a fall event occurs. A fall event is when a user of a stairway 114, where the stairway safety system 100 is installed, falls within the stairway 114. A fall event for a user can occur when traveling either up or down the stairway 114. The central processing unit 102 may be configured to recognize up to four trigger events for determining if a fall event has occurred.

The first trigger event is when the central processing unit 102 determines that input signals from two or more sensors 104, 106 were received or detected, in any order, within a first predetermined time period. This trigger event indicates that a user traveled through the stairway 114 too fast, which indicates a fall event. The first predetermined time period may be arbitrarily selected or entered into the central processing unit 102 based on actual or estimated user travel time through the stairway 114. For example, the stairway safety system 100 could be calibrated to measure a user's typical travel time through the stairway 114 that the stairway safety system 100 is installed. The first predetermined time period is a length of time that is shorter than a user's actual or estimated typical travel time through the stairway 114. For example, the first predetermined time period may be 0.75×, 0.50×, or 0.25× a user's actual or estimated typical travel time through the stairway 114.

The second trigger event is when the central processing unit 102 determines that one or more input signals were received or detected from at least one sensor 104, 106, but at least one signal from another sensor 104, 106 of the stairway safety system 100 was not received or detected within a second predetermined time period. This trigger event indicates that a user may have fallen in the stairway 114 and never reached either the bottom or the top of the stairway 114. Similar to the first predetermined time period, the second predetermined time period may be arbitrarily selected or entered into the central processing unit 102 based on actual or estimated user typical travel time through the stairway 114. The second predetermined time period is a length of time that is longer than a user's actual or estimated typical travel time through the stairway 114. For example, the second predetermined time period may be 3×, 5×, or 10× a user's actual or estimated typical travel time through the stairway 114.

The third trigger event is when the central processing unit 102 receives or detects a signal from one or more of the force sensors 106 indicating that one or more of the force sensors 106 sensed a force above a first predetermined force level. A force above the first predetermined force level indicates that a user has fallen onto the tread 116 or other area of a staircase 118, e.g. a landing of a staircase 118, with more force than would be applied during normal travel through the stairway 114. The first predetermined force level may be arbitrarily selected or entered into the central processing unit 102 based on actual or estimated user typical applied force during travel through the stairway 114. For example, the first predetermined force level may be 1.25×, 1.5×, or 1.75× a user's actual or estimated typical applied force during travel through the stairway.

The fourth trigger event is when the central processing unit 102 determines that one or more of the force sensors 106 sent an input signal to the central processing unit 102 out of turn. An out of turn force sensor 106 signal occurs when a force sensor 106 signal is detected from a first force sensor 106, but then the next force sensor 106 signal detected is received from a force sensor 106 not in sequential order of the force sensors 106 installed in the staircase 118. For example, if a subsequent second force sensor 106 signal received is from a force sensor 106 more than one step tread 116 from the previous force sensor 106 location, for example, two, three or four step treads 116 away. Force sensor 106 signals received out of turn indicates a user has fallen within the stairway 114.

The present disclosure advantageously provides a central processing unit 102 capable of storing predetermined time periods and a safety time period, as will be discussed in greater detail below, through calibration and/or manual selection. This is advantageous at least because not every user travels at the same speed and also because different stairways may be constructed with different distances. The present disclosure also advantageously provides a central processing unit 102 capable of storing different force values through calibration or manual selection. This is advantageous as not every user will apply similar force values to treads 116 of a staircase 118 and also because predetermined force levels can be selected to lessen the probability and/or the number of times a household pet, child or other less heavy stairway traveler than the intended user triggers a fall event determination by the central processing unit 102. Thus, the central processing unit 102 may be configured to disregard detected force signals below a preselected magnitude to avoid triggering a false fall event determination.

While FIG. 1 shows an exemplary stairway safety system 100 installed in a traditional straight stairway 114, it should be understood that the stairway safety system 100 may be installed in other types of stairways in accordance with principles of the present disclosure including, without limitation, stairways with an intermediate landing, curved stairways, U-shaped stairways, L-shaped stairways, double L-shaped stairways, spiral stairways, and the like. Stairway safety systems 100 are advantageous in applications where monitoring of user stairway travel is desired.

Figure 4:
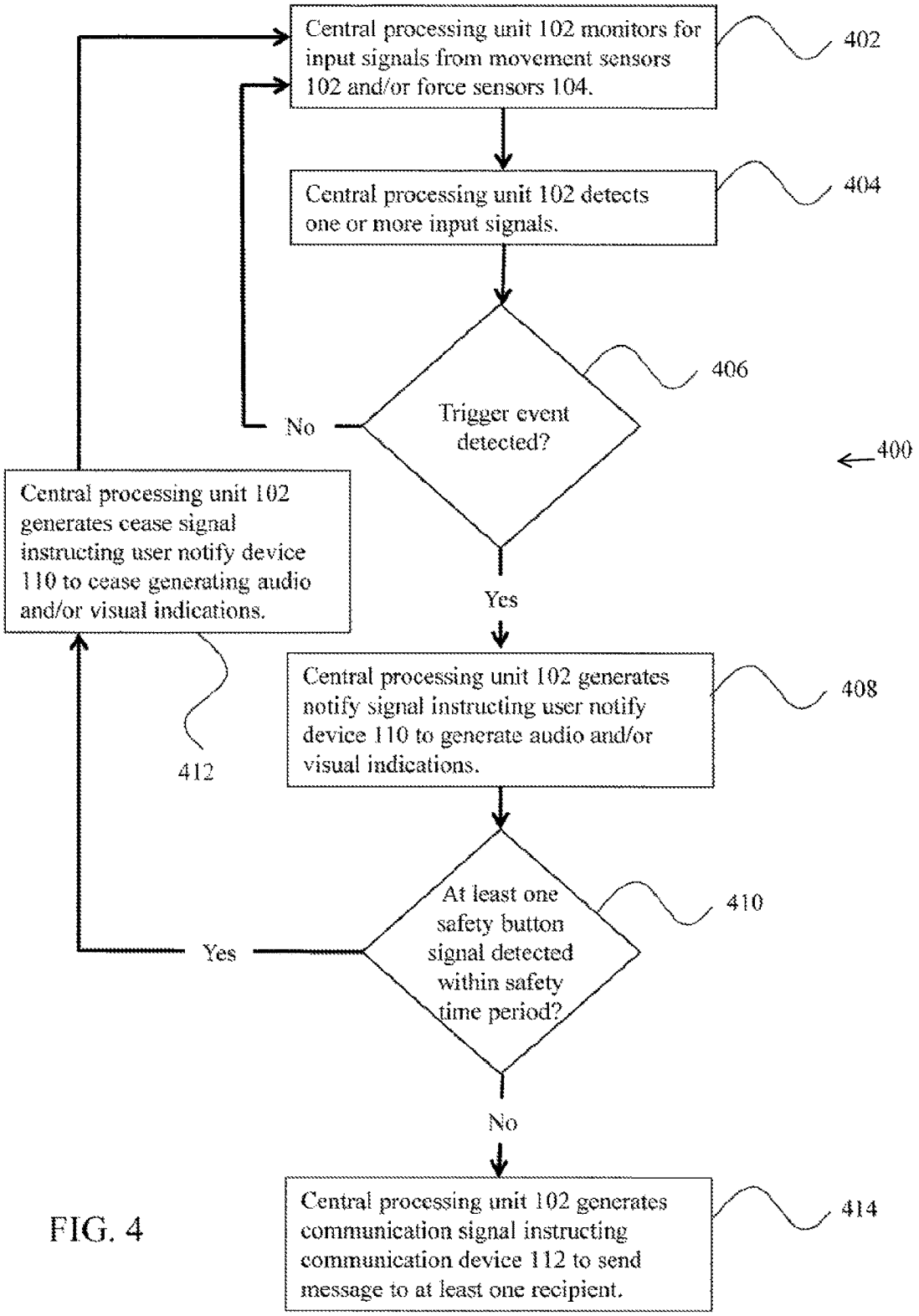
FIG. 4 is a flow chart illustrating an exemplary method capable of being executed by the stairway safety system of FIG. 1.

With reference to FIG. 4, the stairway safety system 100 may be adapted to execute the illustrated exemplary method 400 in order to monitor stairway travel activity and also to request help for a user if necessary. The exemplary method 400 includes monitoring 402 by the central processing unit 102 for input signals received from movement sensors 104 and/or force sensors 106, i.e. movement signals and/or force signals; detecting 404 one or more signals from sensors 104, 106 by the central processing unit 102; and determining 406 by the central processing unit 102 if the one or more signals constitute a trigger event. If the central processing unit 102 determines that the detected one or more signals do constitute a trigger event then the central processing unit 102 will generate 408 a user notify signal that instructs the user notify devices 110 to generate audio and/or visual indications. If the central processing unit 102 determines that the detected one or more signals do not constitute a trigger event then the central processing unit 102 will return to monitoring 402 for signals received from movement sensors 104 and/or force sensors 106. After, or simultaneously with, generating the signal that instructs the user notify devices 110 to generate indications, the central processing unit 102 may begin measuring the time elapsed from when the signal to the user notify devices 110 was sent, i.e. begin measuring a predetermined safety time period. Then the central processing unit 102 determines 410 whether a safety signal is received or detected from at least one of the safety buttons 108 within the predetermined safety time period. If the central processing unit receives or detects a safety signal from at least one of the safety buttons 108 the central processing unit 102 will generate 412 a cease signal that instructs the user notify devices 110 to cease generating audio and/or visual indications and then the central processing unit 102 will return to monitoring 402 for signals received from movement sensors 104 and/or force sensors 106. Thus, in this situation, no help signal will be generated that instructs the communication device 112 to send a message to a recipient.

If, on the other hand, at least one of the safety buttons 108 is not engaged within a predetermined safety time period, the central processing unit 102 will generate 414 a help signal that instructs the communication device 112 to send a message to at least one recipient in the central processing unit's 102 stored emergency contact list. The predetermined safety time period may be arbitrarily selected or entered based on a user's actual or estimated typical amount of time to engage a safety button 108. The safety time period may be set to be slightly longer than a user's actual or estimated typical amount of time to engage a safety button 108 to allow for unplanned delays in engaging the safety button 108. For example, the safety period of time may be entered in the central processing unit 102 as being 1.2×, 1.3×, 1.5× or even longer than a user's actual or estimated typical amount of time to engage a safety button 108. Thus, a safety time period may be set as, for example, 30 seconds.

Figure 5:
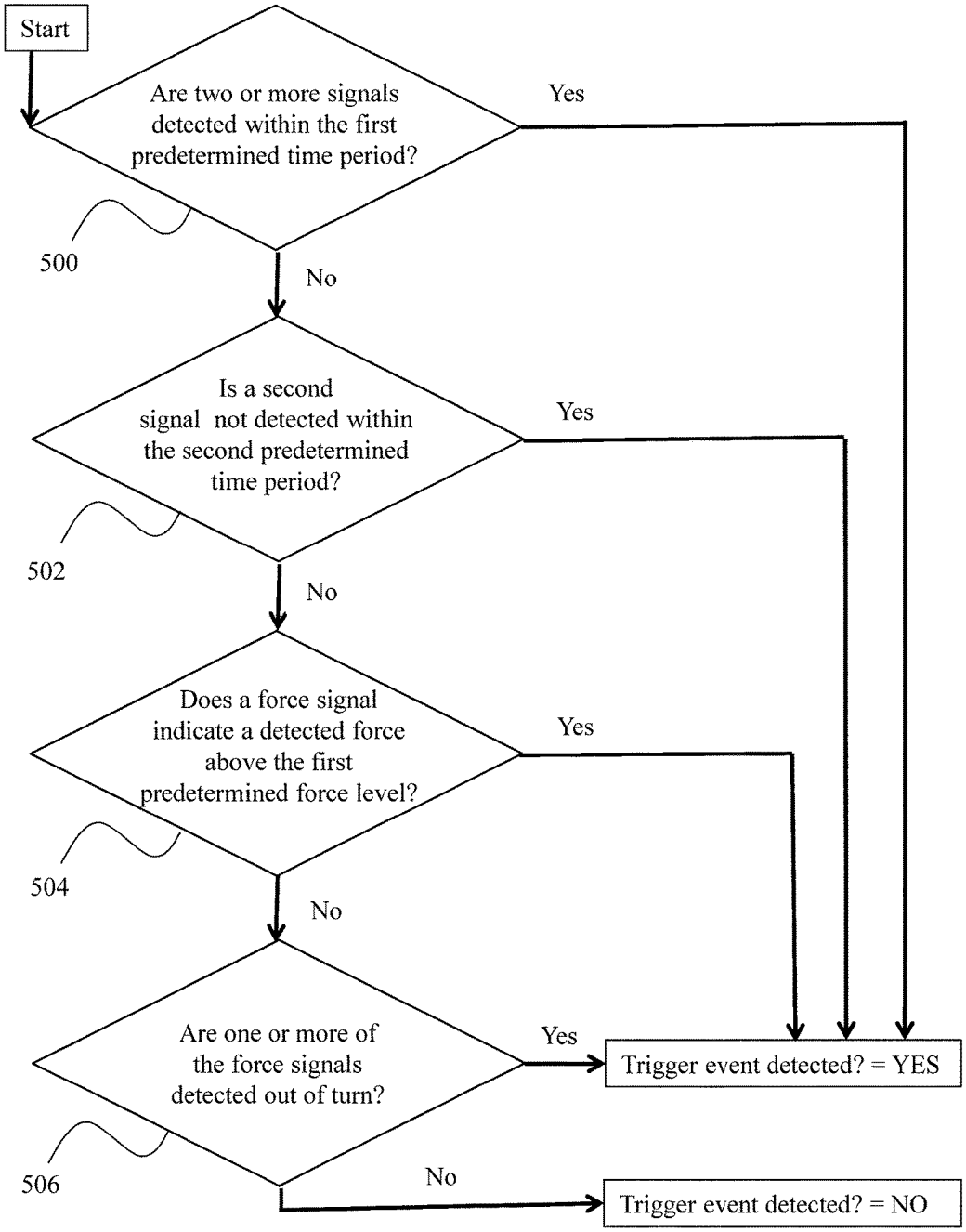
FIG. 5 is a flow chart illustrating an exemplary fall detection algorithm capable of being executed by a central processing unit of the stairway safety system of FIG. 1.

An exemplary algorithm executable by the central processing unit 102 for the step of determining 406 if the one or more signals constitute a first trigger event 500, a second trigger event 502, a third trigger event 504 and/or a fourth trigger event 506 is illustrated in FIG. 5. While FIG. 5 shows a particular order of logic for determining whether the one or more signals constitute a trigger event 500, 502, 504, 506, it should be readily understood that the determination of trigger events 500, 502, 504, 506 may be in any order. Further, an algorithm executable by the central processing unit 102 in accordance with the present disclosure need not include determining all of the trigger events 500, 502, 504, 506. For example, an algorithm in accordance with the present disclosure may only include determining the first trigger event 500 and second trigger event 502.

The present disclosure advantageously provides a method that monitors the movement of a stairway user between spaced stations along a stairway 114 and if the central processing unit 102 determines that movement between the spaced stations is too short or too long, i.e. constituting trigger events 500, 502, 504, 506, then generating audio or visual indications with a user notify device 110 prompting the stairway user to engage a safety button 108.

In operation, the stairway safety system 100 requires a minimum of two sensors. The minimum two sensors can be a mix of different sensor types. For example, the two sensors could be two movement sensors 104, two force sensors 106, or one movement sensor 104 and one force sensor 106. More sensors incorporated into the stairway safety system 100 will allow for more movement and/or force signals capable of being detected by the central processing unit 102. Thus, more stairway use data may be provided to the central processing unit 102 during operation, which may provide better operation of the stairway safety system 100 by decreasing probability of and/or decreasing the number of false positive determinations of a fall event and/or false negative determinations of a fall event.

The present disclosure advantageously provides a stairway safety system 100 and method 400 that does not require affirmative action by a user in order to send a message to request help. This feature is advantageous at least because in some instances a user's fall in a stairway 114 may render the user unconscious or otherwise unable to take any affirmative action in order to request help. Rather, the stairway safety system 100 and method 400 of the present disclosure only requires affirmative action in order to interfere with a request for help, i.e. a message, from being distributed. The present disclosure also provides a stairway safety system 100 and method 400 where users of the stairway 114 are not required to wear any devices if desired. Thus, over extended duration of operation there would be no wearable devices utilized that would require batteries to be changed or recharged.

The exemplary stairway safety system 100 and method 400 is shown and described as including two movement sensors 104, a force sensor 106 for each tread 116, two safety buttons 108 and one user notify device 110, however, it should be understood that a stairway safety system 100 and method 400 in accordance with the principles of the present disclosure can be designed with any number of movement sensors 104, force sensors 106, safety buttons 108 and user notify devices 110.

While the present disclosure has been illustrated and described with respect to particular embodiments thereof, it should be appreciated by those of ordinary skill in the art that various modifications of this disclosure may be made without departing from the spirit and scope of the present disclosure. For example, while the present disclosure provides a stairway safety system well-suited for elderly and/or physically impaired user use, it should be readily understood that principles of the present disclosure can be applied to stairway safety applications where, for example, users are neither elderly nor physically impaired.

What is claimed is:

1. A stairway safety system comprising:

a first movement sensor configured to generate a first movement signal when movement of a stairway user is detected in a first area of a stairway;

a second movement sensor configured to generate a second movement signal when movement of the stairway user is detected in a second area of the stairway remote from the first area of the stairway;

a safety button configured to generate a safety signal when engaged by a stairway user;

a central processing unit configured to detect the first movement signal, second movement signal and safety signal;

a first user notify device configured to generate audio or visual indications prompting the stairway user to engage the safety button; and a communication device configured to send a message requesting help;

wherein the central processing unit is configured to measure the length of time between detecting the first movement signal and the second movement signal;

wherein the central processing unit is configured to generate a first notify signal that instructs the first user notify device to generate the audio or visual indications when the central processing unit determines that the measured time between detecting the movement signals is within a first predetermined time interval;

wherein the central processing unit is configured to measure the length of time from when the first notify signal is generated until the safety signal is detected; and wherein the central processing unit is configured to generate a help signal that instructs the communication device to send the message requesting help if the central processing unit determines that the safety signal is not detected within a predetermined safety time interval during the length of time measured by the central processing unit after the first notify signal is generated, which indicates a request for help may be needed.

2. The stairway safety system of claim 1, wherein the central processing unit is configured to generate the first notify signal that instructs the user notify device to generate audio or visual indications prompting the stairway user to engage the safety button when the central processing unit determines that the measured time between detecting the movement signals is not within a second predetermined time period interval, which is longer than a stairway user's actual or estimated typical travel time through the stairway.

3. The stairway safety system of claim 1, wherein the first movement sensor is configured to be mounted substantially near the top of the stairway and the second movement sensor is configured to be mounted substantially near the bottom of the stairway.

4. The stairway safety system of claim 1, wherein the safety button is configured to be mounted on a wall.

5. The stairway safety system of claim 1, wherein the safety button is configured to be worn by the stairway user.

6. The stairway safety system of claim 1, wherein the safety button is configured to generate a visual effect prompting the user to engage the safety button.

7. The stairway safety system of claim 1, further comprising a second user notify device configured to generate audio or visual indications, wherein the central processing unit is configured to generate a second user notify signal that instructs the second user notify device to generate audio or visual indications prompting the stairway user to engage the safety button when the measured time between detecting the movement signals is within the first predetermined time interval.

8. The stairway safety system of claim 1, wherein the central processing unit includes a memory unit configured to store an emergency contact list, and wherein the help signal instructs the communication device to send the message requesting help to at least one recipient contained within the emergency contact list.

9. The stairway safety system of claim 1, wherein the central processing unit is configured to generate, when the central processing unit determines that the safety signal is detected within the predetermined safety time interval, a cease signal that instructs the first user notify device to cease generating the audio or visual indications.

10. The stairway safety system of claim 1, further comprising a force sensor configured to be positioned under, within or on top of a tread of a staircase and also to generate a force signal when a force is applied to the force sensor, wherein the central processing unit is configured to detect the force signal, wherein the central processing unit is configured to measure the length of time between detecting the first movement signal and the force signal, in either order, or the second movement signal and the force signal, in either order, and wherein the central processing unit is configured to generate the first notify signal that instructs the first user notify device to generate audio or visual indications prompting the stairway user to engage the safety button when the central processing unit determines that the measured time between detecting the first movement signal and the force signal, in either order, or the second movement signal and the force signal, in either order, is within the first predetermined time period interval.

11. A stairway safety system comprising:

a first force sensor configured to be positioned under, within or on top of a first tread of a staircase and to generate a first force signal when a force is applied to the first force sensor by a stairway user;

a second force sensor configured to be positioned under, within or on top of a second tread of the staircase and to generate a second force signal when a force is applied to the second force sensor by the stairway user;

a safety button configured to generate a safety signal when engaged by a stairway user;

a central processing unit configured to detect the first force signal, second force signal and safety signal;

a first user notify device configured to generate audio or visual indications prompting the stairway user to engage the safety button; and a communication device configured to send a message requesting help;

wherein the central processing unit is configured to measure the length of time between detecting the first force signal and the second force signal, in either order;

wherein the central processing unit is configured to generate a first notify signal that instructs the first user notify device to generate the audio or visual indications when the central processing unit determines that the measured time between detecting the first force signal and the second force signal, in either order, is within a first predetermined time interval;

wherein the central processing unit is configured to measure the length of time from when the first notify signal is generated until the safety signal is detected; and wherein the central processing unit is configured to generate a help signal that instructs the communication device to send the message requesting help if the central processing unit determines that the safety signal is not detected within a predetermined safety time period interval during the length of time measured by the central processing unit after the first notify signal is generated, which indicates a request for help may be needed.

12. The stairway safety system of claim 11, wherein the central processing unit is configured to generate the first notify signal that instructs the first user notify device to generate audio or visual indications when the central processing unit determines that the measured time between detecting the first force signal and the second force signal, in either order, is not within a second predetermined time period interval, which is longer than the stairway user's actual or estimated typical travel time through the stairway.

13. The stairway safety system of claim 11, further comprising a plurality of additional force sensors configured to be positioned under, within or on top of different treads of the staircase and generate additional force signals, wherein the central processing unit is configured to detect the additional force signals.

14. The stairway safety system of claim 13, wherein the central processing unit is configured to generate the first notify signal that instructs the first user notify device to generate audio or visual indications prompting the stairway user to engage the safety button when the central processing unit determines that detected force signals are received out of turn.

15. The stairway safety system of claim 11, wherein the first force sensor and the second force sensor are configured to detect forces of varying magnitude and wherein the first force signal and the second force signal are varying force signals indicative of the sensed magnitude of the force applied to the force sensor, and wherein the central processing unit is configured to generate the first notify signal that instructs the first user notify device to generate audio or visual indications prompting the stairway user to engage the safety button when the central processing unit determines that the magnitude of the force applied to the force sensor is above a first predetermined force level which indicates the stairway user has fallen.

16. The stairway safety system of claim 15, wherein the central processing unit is configured to disregard force signals below a preselected magnitude.

17. A stairway safety method comprising the steps of:

monitoring, by a central processing unit, the movement of a stairway user between spaced stations along a stairway;

determining, by the central processing unit, if a duration of time of the movement between spaced stations is shorter than a first predetermined time interval or longer than a second predetermined time interval; and generating, by a user notify device, audio or visual indications prompting the stairway user to engage a safety button.

18. The stairway safety method of claim 17, further comprising the steps of:

measuring, by the central processing unit, a predetermined safety time period interval beginning at the time the audio or visual indications are generated by the user notify device; and determining, by the central processing unit, if a safety signal generated from a safety button is detected within the predetermined safety time interval.

19. The stairway safety method of claim 18, further comprising generating a cease signal, by the central processing unit, that instructs the user notify device to cease generating the audio or visual indications.

20. The stairway safety method of claim 19, further comprising:

generating, by the central processing unit, a help signal that instructs a communication device to send a message requesting help; and sending, by the communication device, the message to at least one recipient contained in an emergency contact list stored in a memory unit.

* * * * *